US007078860B2

(12) United States Patent
Miura et al.

(10) Patent No.: US 7,078,860 B2
(45) Date of Patent: Jul. 18, 2006

(54) METAL VAPOR DISCHARGE LAMP HAVING CONFIGURED ENVELOPE FOR STABLE LUMINOUS CHARACTERISTICS

(75) Inventors: Mikio Miura, Takatsuki (JP); Shunsuke Kakisaka, Ibaraki (JP); Yoshiharu Nishiura, Otsu (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 218 days.

(21) Appl. No.: 10/806,187

(22) Filed: Mar. 23, 2004

(65) Prior Publication Data

US 2004/0189207 A1 Sep. 30, 2004

(30) Foreign Application Priority Data

Mar. 28, 2003 (JP) ..... 2003-091460

(51) Int. Cl.
*H01J 61/30* (2006.01)
*H01J 61/36* (2006.01)

(52) U.S. Cl. ..... 313/634; 313/631; 313/639; 313/573

(58) Field of Classification Search ..... 313/634
See application file for complete search history.

(56) References Cited

U.S. PATENT DOCUMENTS 6,707,252 B1 * 3/2004 Kakisaka et al. ..... 313/623
6,747,411 B1 * 6/2004 Miyazawa ..... 313/634
2004/0263080 A1 * 12/2004 Brates et al. ..... 313/634

FOREIGN PATENT DOCUMENTS

JP 2000-100386 A 4/2000
JP 2000-340171 A 12/2000
JP 2002-164019 A 6/2002

* cited by examiner

*Primary Examiner*—Karabi Guharay
*Assistant Examiner*—Sikha Roy
(74) *Attorney, Agent, or Firm*—McDermott Will & Emery LLP

(57) ABSTRACT

A metal vapor discharge lamp, comprises: a translucent ceramic envelope, the envelope comprising a center bulb for defining a discharge space and side tubes, the center bulb and the side tubes being integrally molded; a pair of current suppliers extending through hollows of the side tubes respectively, each of the current suppliers comprising an electrode and a lead-in wire, a first end of the electrode being disposed in the discharge space, a second end of the electrode being connected with the lead-in wire; a sealant for hermetically sealing open ends of the side tubes; and a light-emitting metal contained in the discharge space. An inner wall and an external wall of a seamless boundary portion between the center bulb and each of the side tubes have the smallest curvature radius of $R_i$ mm and $R_o$ mm, respectively. The center bulb has an inner diameter of D mm. The lamp has an electric power of P watts. The radius $R_i$, radius $R_o$, diameter D and electric power P satisfy, $$-0.00076P+0.304 \leqq R_i/D \leqq -0.00076P+0.490, \quad \text{Formula (1)}$$

where $P \leqq 350$ watts; and $$1.28R_o \leqq R_i \leqq 1.39R_o. \quad \text{Formula (2)}$$

2 Claims, 3 Drawing Sheets

METAL VAPOR DISCHARGE LAMP HAVING CONFIGURED ENVELOPE FOR STABLE LUMINOUS CHARACTERISTICS

BACKGROUND OF THE INVENTION

With regard to envelopes of metal vapor discharge lamps, envelopes made of translucent ceramic such as alumina ceramic have become increasingly common these days in place of conventional quartz glass. Translucent ceramic is more excellent in heat resistance than quartz glass and suitable for envelopes of high pressure discharge lamps, such as metal vapor discharge lamps, whose temperature becomes high when the lamps are on. For example, alumina ceramic has lower reactivity with light-emitting metals to be enclosed in an envelope than quartz glass, and it can thus be expected to prolong the life of metal vapor discharge lamps.

A typical envelope of a metal vapor discharge lamp comprises: a center bulb for defining a discharge space and a pair of side tubes being extended from both ends of the center bulb. The side tubes have outer diameters smaller than that of the center bulb. Current suppliers are extending through hollows of the side tubes respectively. The current supplier comprises a lead-in wire and an electrode fixed with a coil. The coil is disposed in the discharge space. The lead-in wire is fixed to the inside of the side tube by means of a sealant. The sealant hermetically seals open ends of the side tubes. As for the sealant used is glass frit or the like.

When a metal vapor discharge lamp is turned on in such a state as an electrode of the current supplier is oriented in the vertical direction, the light-emitting metal enclosed in the discharge space easily sinks into a gap between the lead-in wire and the side tube disposed on the lower side of the vertical direction. When the light-emitting metal sinks into the gap, an amount of the light-emitting metal to contribute to luminescence in the discharge space is reduced, resulting in insufficient vapor pressure and a larger variation in color temperature. It is often the case that, even if characteristics of a metal vapor discharge lamp are sufficient immediately after the lamp is turned on, the characteristics vary significantly several hundred or several thousands hours after the lamp is turned on. Although increasing the amount of the light-emitting metal can be considered as a means to prevent the abovementioned problem, such an increase may promote the reaction of the light-emitting metal with the electrode or ceramic, deteriorating the life characteristic of the lamp.

There has been proposed a metal vapor discharge lamp using an envelope where a center bulb has been bonded to side tubes by shrink-fitting. In this lamp regulated is a position of a coil to be disposed in the vicinity of an end of the electrode in the envelope. This regulation enables control of a temperature of the shrink-fitting portion to inhibit a light-emitting metal from sinking (Japanese Laid-Open Patent Publication No. 2000-340171). According to this proposal, the light-emitting metal in a liquid state can exist at the shrink-fitting portion of a low-temperature because the shrink fitting portion has a thickness larger than those of the center bulb and the side tubes. This makes it possible to reduce the amount of the light-emitting metal that sinks into the gap between the current supplier and each of the side tubes than in the conventional practice.

On the other hand, in a translucent ceramic envelope where a center bulb has been integrally molded with side tubes, the smallest curvature radius of an inner wall of a boundary portion between the center bulb and each of side tubes tends to become large. This is ascribable to a method of producing such an envelope. For this reason, in a metal vapor discharge lamp using the integrally molded envelope, a liquid light-emitting metal tends to flow down into the gap between the current supplier and each of the side tubes. Accordingly, it has been proposed that the smallest curvature radius of the inner wall of the boundary portion between the center bulb and each of the side tubes be controlled to a small value. The boundary portion so controlled is resistant to allowing the metal to flow thereon (Japanese Laid-Open Patent Publication No. 2002-164019).

However, in the case of shaping the boundary portion between the center bulb and each of the side tubes as described above, it becomes difficult to regulate the temperature of the boundary portion, raising a problem that favorable metal vapor pressure cannot be obtained. In order to obtain a metal vapor discharge lamp having a stable luminous characteristic, it is necessary to keep the boundary portion at such a temperature as favorable metal vapor pressure can be obtained as well as to control the shape of the boundary portion.

BRIEF SUMMARY OF THE INVENTION

The present invention relates to a metal vapor discharge lamp, and particularly relates to a metal vapor discharge lamp using an envelope made of a translucent ceramic such as alumina ceramics.

It is an object of the present invention to provide a metal vapor discharge lamp where a color temperature variation is small and a stable luminous characteristic is sustained even when the lamp is on for a long period of time, by attaining both inhibition of a liquid metal from flowing down into a gap between a center bulb and each of side tubes and sustainment of favorable metal vapor pressure.

With the aim of accomplishing the above object, in the present invention, the relationship among: the smallest curvature radius $R_i$ (mm) of an inner wall of a boundary portion between a center bulb and each of side tubes; the inner diameter D (mm) of the center bulb correlated with the $R_i$ value; and a lamp electric power P (W); is optimized while the smallest curvature radius $R_o$ (mm) of an external wall of the boundary portion between the center bulb and each of the side tubes is controlled.

Namely, the present invention relates to a metal vapor discharge lamp, comprising: (a) a translucent ceramic envelope, the ceramic envelope comprising a center bulb for defining a discharge space and side tubes being extended from both ends of the center bulb, the side tubes having outer diameters smaller than that of the center bulb, the center bulb and the side tubes being integrally-molded; (b) a pair of current suppliers extending through hollows of the side tubes respectively, each of the current suppliers comprising an electrode and a lead-in wire, the electrode being fixed with a coil disposed in the discharge space, a first end of the electrode being disposed in the discharge space, a second end of the electrode being connected with the lead-in wire; (c) a sealant for hermetically sealing open ends of the side tubes to fix the lead-in wires to the side tubes; and (d) a light-emitting metal contained in the discharge space, wherein an inner wall of a seamless boundary portion between the center bulb and each of the side tubes has the smallest curvature radius of $R_i$ mm, an external wall of the boundary portion has the smallest curvature radius of $R_o$ mm, the center bulb has an inner diameter of D mm, the lamp has an electric power of P watts, and the curvature radius $R_i$, the curvature radius $R_o$, the diameter D and the electric power P satisfy:

$$-0.00076P+0.304 \leqq R_i/D \leqq -0.00076P+0.490, \quad \text{Formula (1)}$$

where P≦350 watts; and $$1.28R_o \leqq R_i \leqq 1.39R_o \quad \text{Formula (2)}$$

The aforementioned configuration enables both inhibition of the light-emitting metal present in a liquid state from flowing down into the gap between the current supplier and each of the side tubes when the lamp is on or immediately after it is turned off, and sustainment of favorable metal vapor pressure, whereby it is possible to maintain a stable color temperature for a long period of time.

In the metal vapor discharge lamp, it is preferable that a distance ($L_1$) between the first end of the electrode and the open end of the side tube which is nearer to the first end, and a distance ($L_2$) between the first end and a position where an inner wall of the nearer side tube begins to bend, satisfy:

$$0.28 \leqq L_2/L_1 \leqq 0.38 \quad \text{Formula (3)}$$

While the novel features of the invention are set forth particularly in the appended claims, the invention, both as to organization and content, will be better understood and appreciated, along with other objects and features thereof, from the following detailed description taken in conjunction with the drawings.

DETAILED DESCRIPTION OF THE INVENTION

In the following, one embodiment of a metal vapor discharge lamp of the present invention is described with reference to drawings.

Figure 1:
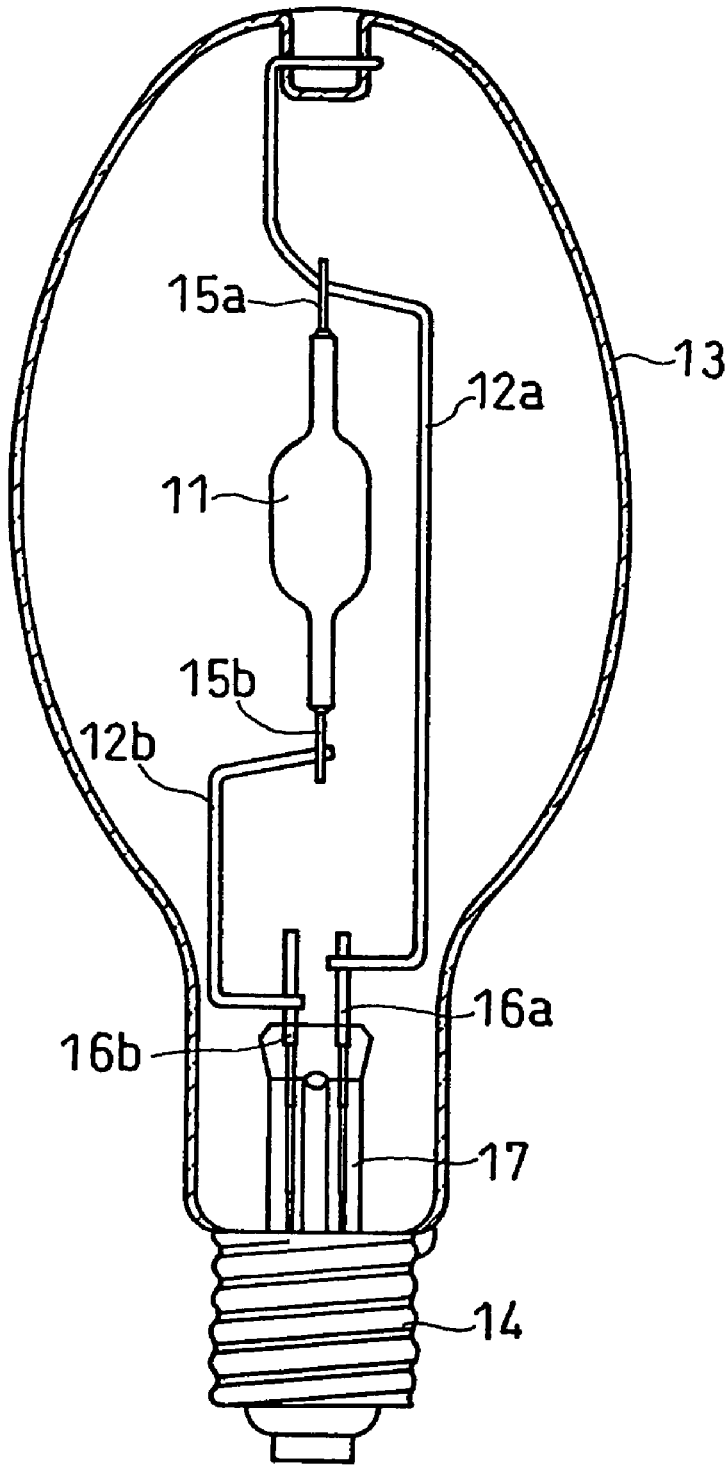
FIG. 1 is a front view for showing an internal structure of one example of a metal vapor discharge lamp in accordance with the present invention, with an outer tube shown in cross section.

FIG. 1 is regarded here as a front view, with an outer tube shown in cross section, for showing an internal structure of a metal vapor discharge lamp of 200 W.

The metal vapor discharge lamp in FIG. 1 comprises: a luminous tube 11 using an envelope made of alumina ceramic; an outer tube 13 for housing the luminous tube 11; current supplying leads 12*a* and 12*b* for supplying electric power to lead-in wires 15*a* and 15*b* projecting from both ends of the luminous tube 11; and a metal base 14 mounted to the outer tube 13. A prescribed pressure of nitrogen gas is enclosed in the outer tube 13, which is hermetically sealed by the installment of the metal base 14. The current supplying lead 12*a* supports one of the lead-in wires, 15*a*, disposed at the upper part of the luminous tube 11. One end of the current supplying lead 12*a* is fixed to the head of the outer tube 13 while the other end is fixed to a supporting lead 16*a* projecting from a stem 17. One end of the current supplying lead 12*b* supports the other of the lead-in wires, 15*b*, disposed at the lower part of the luminous tube 11, and the other end of the current supplying lead 12*b* is fixed to the supporting lead 16*b* projecting from the stem 17. The supporting leads 16*a* and 16*b* are partially sealed by the stem 17.

Figure 2:
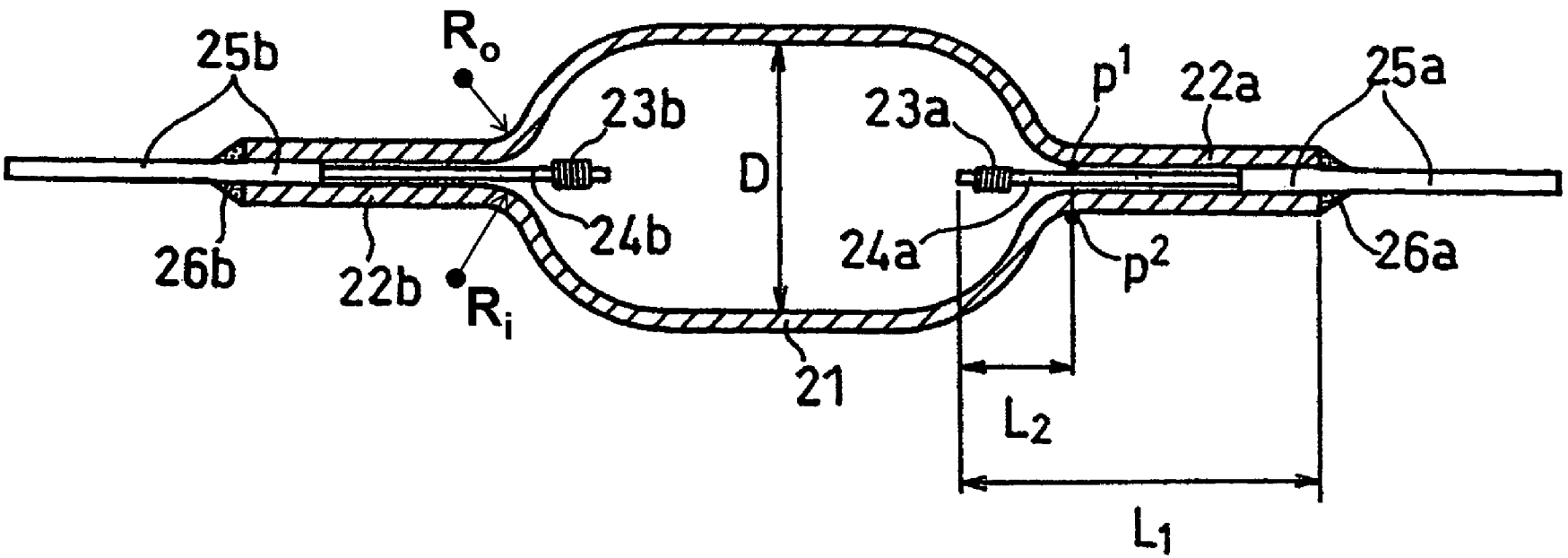
FIG. 2 is a side view for showing an internal structure of a luminous tube with an envelope shown in cross section.

FIG. 2 is a side view, with the envelope shown in cross section, for showing an internal structure of the luminous tube 11.

This envelope comprises: a center bulb 21 having tapering ends; and side tubes 22*a* and 22*b* which are extended from both ends of the center bulb 21 and have outer diameters smaller than that of the center bulb. In the case of a metal vapor discharge lamp of 20 to 350 W, for example, the center bulb 21 of the envelope normally has a thickness of 0.4 to 1.5 mm. Inside the envelope enclosed is a light-emitting metal (not shown) as well as mercury and a noble gas. The center bulb 21 is integrally molded with the side tubes 22*a* and 22*b*. Therefore, a seamless boundary portion between the center bulb and each of the side tubes has an inner-side inflection point $p^1$ where the inner wall of each of the side tubes 22*a* and 22*b* begins to bend and an outer-side inflection point $p^2$ where the outer wall of each of the side tubes begins to bend.

Current suppliers are inserted into the hollows of the side tubes 22*a* and 22*b*, respectively. The current suppliers comprise electrodes 24*a* and 24*b* equipped with coils 23*a* and 23*b* around one ends thereof (first ends), and lead-in wires 25*a* and 25*b* connected to other ends (second ends) of the electrodes 24*a* and 24*b*. The coils 23*a* and 23*b* are disposed so as to face each other in the discharge space. Pin portions of the electrodes 24*a* and 24*b* are made of tungsten, for example. The lead-in wires 25*a* and 25*b*, connected to the electrodes, are made of conductive cermet and have a thermal expansion coefficient almost equivalent to that of alumina ceramic forming the envelope. As the conductive cermet used is a material obtained by mixing a metal powder with a ceramic powder and then sintering the mixture.

The lead-in wires 25*a* and 25*b* are projecting from open ends of the side tubes 22*a* and 22*b*, and are fixed to the side tubes in the vicinity of the open ends by means of sealants 26*a* and 26*b*. For the sealants 26*a* and 26*b* used for example is glass frit. This glass frit comprises a metal oxide such as alumina or silica. Although not clear in FIG. 2, practically, glass frit in a molten state is flown from the open ends of the side tubes 22*a* and 22*b* toward the center bulb. The sealant flown into the side tubes usually has a length of 2 to 7 mm in the case of a lamp of 20 to 350 W, for example.

In order to attain both inhibition of the liquid metal from flowing down into the gap between the current supplier and each of the side tubes, and sustainment of favorable metal vapor pressure, it is necessary to satisfy the following. When the smallest curvature radius of an inner wall of the seamless boundary portion between the center bulb and each of the side tubes is represented by $R_i$ mm, the ratio ($R_i$/D) of the curvature radius $R_i$ (mm) to the inner diameter D (mm) of the center bulb 21, and the lamp electric power P (W) satisfy the following Formula (1):

$$-0.00076P+0.304 \leqq R_i/D \leqq -0.00076P+0.490,$$

where P≦350 watts.

When the $R_i$/D value is below the lower limit of the range of Formula (1), a load applied to the tube wall becomes too small to obtain sufficient metal vapor pressure. It may also be possible that the distance between the first end of the electrode disposed in the discharge space and the boundary portion between the center bulb and each of the side tubes becomes shorter to cause occurrence of cracking in the boundary portion. When the $R_i$/D value exceeds the upper limit of the range of Formula (1), on the other hand, it is not possible to inhibit the liquid metal from flowing down into the gap between the current supplier and each of the side tubes, leading to an increased variation in color temperature of the lamp. Such a tendency is significant especially when the lamp electric power P is in the range: $10 \leqq P \leqq 350$. When the lamp electric power P exceeds 350 W, the size of the envelope increases and thereby sufficient metal vapor pressure cannot be obtained in the range of Formula (1) to lower efficiency. Although increasing current may be considered as a means to inhibit the lowering of the efficiency, that necessitates enlargement of the electrode diameter. However, enlarging the electrode diameter unfavorably causes an increase in heat loss.

Next, it is necessary that, when the smallest curvature radius of an external wall of the seamless boundary portion between the center bulb and each of the side tubes is represented by $R_o$ mm, the curvature radius $R_i$ and the curvature radius $R_o$ satisfy:

$$1.28R_o \leqq R_i \leqq 1.39R_o \qquad \text{Formula (2)}$$

When the curvature radius $R_i$ and the curvature radius $R_o$ do not satisfy Formula (2), it becomes difficult to attain both inhibition of the liquid metal from flowing down into the gap between the current supplier and each of the side tubes, and sustainment of favorable metal vapor pressure.

In FIG. 2, a distance between the first end of the electrode disposed in the discharge space and the open end of the side tube which is nearer to the first end is expressed by a horizontal distance $L_1$; a distance between the first end of the electrode and the position where the inner wall of the nearer side tube begins to bend (namely, the point $p^1$) is expressed by a horizontal distance $L_2$.

It is preferable that $L_1$ and $L_2$ satisfy:

$$0.28 \leqq L_2/L_1 \leqq 0.38 \qquad \text{Formula (3)}$$

Even when the $L_2/L_1$ value is below the lower limit or over the upper limit of the range of Formula (3), the light-emitting metal sinks into the gap between the current supplier and each of the side tubes to cause a larger variation in color temperature. It is to be noted that: when $L_1$ is too short, the distance from the first end of the electrode to the sealant having been flown into each of the side tubes becomes shorter, whereby it becomes possible that cracking may occur in the portion hermetically sealed by the sealant; when $L_2$ is too short, the distance from the first end of the electrode to the boundary portion between the center bulb and each of the side tubes becomes shorter, whereby it becomes possible that cracking may occur in the boundary portion between the center bulb and each of the side tubes.

A more specific description of the present invention is given below based on examples.

EXAMPLE 1

A luminous tube having an envelope made of alumina ceramic as shown in FIG. 2 was produced, and using this tube, a metal vapor discharge lamp as shown in FIG. 1, with an electric power of 200 W, was produced.

Herein, a ratio ($R_i$/D) of the smallest curvature radius $R_i$ (mm) of the inner wall of the boundary portion between the center bulb and each of the side tubes to the inner diameter D (mm) of the center bulb in the envelope was varied as shown in Table 1.

The inner diameter D of the center bulb was 12.9 mm and the inner diameter of each of the side tubes was 1.3 mm.

In the discharge space enclosed as light-emitting metals were 0.9 mg of $DyI_3$, 0.7 mg of $HoI_3$, 0.9 mg of $TmI_3$, 2.8 mg of NaI and 0.9 mg of TlI.

In the discharge space further enclosed were 310 hPa of argon as a noble gas and 29.2 mg of mercury.

As for pin portions of electrodes used were pins made of tungsten, having an outer diameter of 0.6 mm and a length of 12.5 mm.

As for lead-in wires used was conductive cermet (thermal expansion coefficient: $7.0 \times 10^{-6}$) having an outer diameter of 1.2 mm and a length of 20 mm, obtained by mixing a molybdenum powder with an alumina powder, and then sintering the mixture.

As for a sealant used was glass frit made of alumina, silica or the like.

The rate of "the distance from the first end of the electrode to the portion where the inner wall of the nearer side tube begins to bend ($L_2$ in FIG. 2)" to "the distance from the first end of the electrode to the nearer open end of the side tube ($L_1$ in FIG. 2)" was fixed to 0.32. $L_1$ was 17.8 mm.

Table 1 shows the relationship among the $L_2/L_1$ value, the $R_i$/D value and the color temperature variation after a 6000 hour life test. In the life test, the lamp was operated with the cycle including lightings each for 5.5 hours and continuous extinguishing each for 0.5 hour. It is to be noted that, in the present example and below examples, the color temperature variation was expressed by an increase (K) from the color temperature after the lapse of 30 minute lightening.

TABLE 1

| $L_2/L_1$ | $R_i$/D | *A |
|---|---|---|
| 0.32 | 0.13 | 420 |
| | 0.15 | 340 |
| | 0.16 | 265 |
| | 0.20 | 250 |
| | 0.25 | 265 |
| | 0.31 | 270 |
| | 0.33 | 275 |
| | 0.34 | 320 |
| | 0.36 | 390 |
| | | (200 W) |

*A: Color temperature variation (K) after the lapse of 6000 hour life

EXAMPLE 2

Except that the lamp electric power was changed from 200 W to 300 W, a metal vapor discharge lamp was produced and then evaluated in the same manner as in Example 1.

However, the inner diameter D of the center bulb was 17.1 mm and the inner diameter of each of the side tubes was 1.3 mm.

In the discharge space enclosed as light-emitting metals were 2.3 mg of $DyI_3$, 1.9 mg of $HoI_3$, 2.3 mg of $TmI_3$, 6.7 mg of NaI and 2.3 mg of TlI.

In the discharge space further enclosed were 310 hPa of argon as the noble gas and 56.4 mg of mercury.

As for the pin portions of the electrodes used were pins made of tungsten, having an outer diameter of 0.7 mm and a length of 17.8 mm.

As for the lead-in wires used was conductive cermet (thermal expansion coefficient: $7.0 \times 10^{-6}$) having an outer diameter of 1.2 mm and a length of 40 mm, obtained by mixing a molybdenum powder with an alumina powder, and then sintering the mixture.

As for the sealant used was glass frit made of alumina, silica or the like.

The rate of the distance $L_2$ from the first end of the electrode to the position where the inner wall of the nearer side tubes begins to bend to the distance $L_1$ from the first end of the electrode to the nearer open end of the side tubes was fixed to 0.33. $L_1$ was 22.9 mm.

Table 2 shows the relationship among the $L_2/L_1$ value, the $R_i/D$ value and the color temperature variation after the 6000 hour life test.

TABLE 2

| $L_2/L_1$ | $R_i/D$ | *A |
|---|---|---|
| 0.33 | 0.05 | 432 |
| | 0.06 | 320 |
| | 0.08 | 271 |
| | 0.10 | 260 |
| | 0.20 | 268 |
| | 0.25 | 250 |
| | 0.26 | 259 |
| | 0.28 | 350 |
| | 0.30 | 398 |
| | | (300 W) |

*A: Color temperature variation (K) after the lapse of 6000 hour life

EXAMPLE 3

Except that the lamp electric power was changed from 200 W to 150 W, a metal vapor discharge lamp was produced and then evaluated in the same manner as in Example 1.

However, the inner diameter D of the center bulb was 12.0 mm and the inner diameter of each of the side tubes was 0.8 mm.

In the discharge space enclosed as light-emitting metals were 0.8 mg of $DyI_3$, 0.6 mg of $HoI_3$, 0.8 mg of $TmI_3$, 2.2 mg of NaI and 0.8 mg of TlI.

In the discharge space further enclosed were 150 hPa of argon as the noble gas and 9.0 mg of mercury.

As for the pin portions of the electrodes used were pins made of tungsten, having an outer diameter of 0.5 mm and a length of 13.5 mm.

As for the lead-in wires used was conductive cermet (thermal expansion coefficient: $7.0\times10^{-6}$) having an outer diameter of 0.7 mm and a length of 20 mm, obtained by mixing a molybdenum powder with an alumina powder, and then sintering the mixture.

As for the sealant used was glass frit made of alumina, silica or the like.

The rate of "the distance $L_2$ from the first end of the electrode to the position where the inner wall of the nearer side tube begins to bend" to "the distance $L_2$ from the first end of the electrode to the nearer open end of the side tube" was fixed to 0.31. $L_1$ was 19.5 mm.

Table 3 shows the relationship among the $L_2/L_1$ value, the $R_i/D$ value and the color temperature variation after the 6000 hour life test.

TABLE 3

| $L_2/L_1$ | $R_i/D$ | *A |
|---|---|---|
| 0.31 | 0.15 | 510 |
| | 0.18 | 343 |
| | 0.19 | 280 |
| | 0.25 | 271 |
| | 0.30 | 281 |
| | 0.35 | 277 |
| | 0.37 | 302 |
| | 0.38 | 381 |
| | 0.45 | 420 |
| | | (150 W) |

*A: Color temperature variation (K) after the lapse of 6000 hour life

[Consideration 1]

In Example 1, when the P values are substituted into Formula (1), the following inequalities are obtained:

$$0.190 \leqq R_i/D \leqq 0.376, \text{ when } P=150 \text{ W}$$

$$0.152 \leqq R_i/D \leqq 0.338, \text{ when } P=200 \text{ W}$$

$$0.076 \leqq R_i/D \leqq 0.262, \text{ when } P=300 \text{ W}$$

In Table 1, with P=200 W, the color temperature variation is significant when the $R_i/D$ value is not larger than 0.15 and not smaller than 0.34; the color temperature variation is small when $0.152 \leqq R_i/D \leqq 0.338$.

In Table 2, with P=300 W, the color temperature variation is significant when the $R_i/D$ value is not larger than 0.06 and not smaller than 0.28; the color temperature variation is small when $0.076 \leqq R_i/D \leqq 0.262$.

In Table 3, with P=150 W, the color temperature variation is significant when the $R_i/D$ value is not larger than 0.18 and not smaller than 0.38; the color temperature variation is small when $0.190 \leqq R_i/D \leqq 0.376$.

It is understood from the above results that, in order to obtain an excellent luminescence characteristic, it is necessary that at least the smallest curvature radius $R_i$ of the inner wall of the boundary portion between the center bulb and each of the side tubes satisfy Formula (1).

Figure 3:
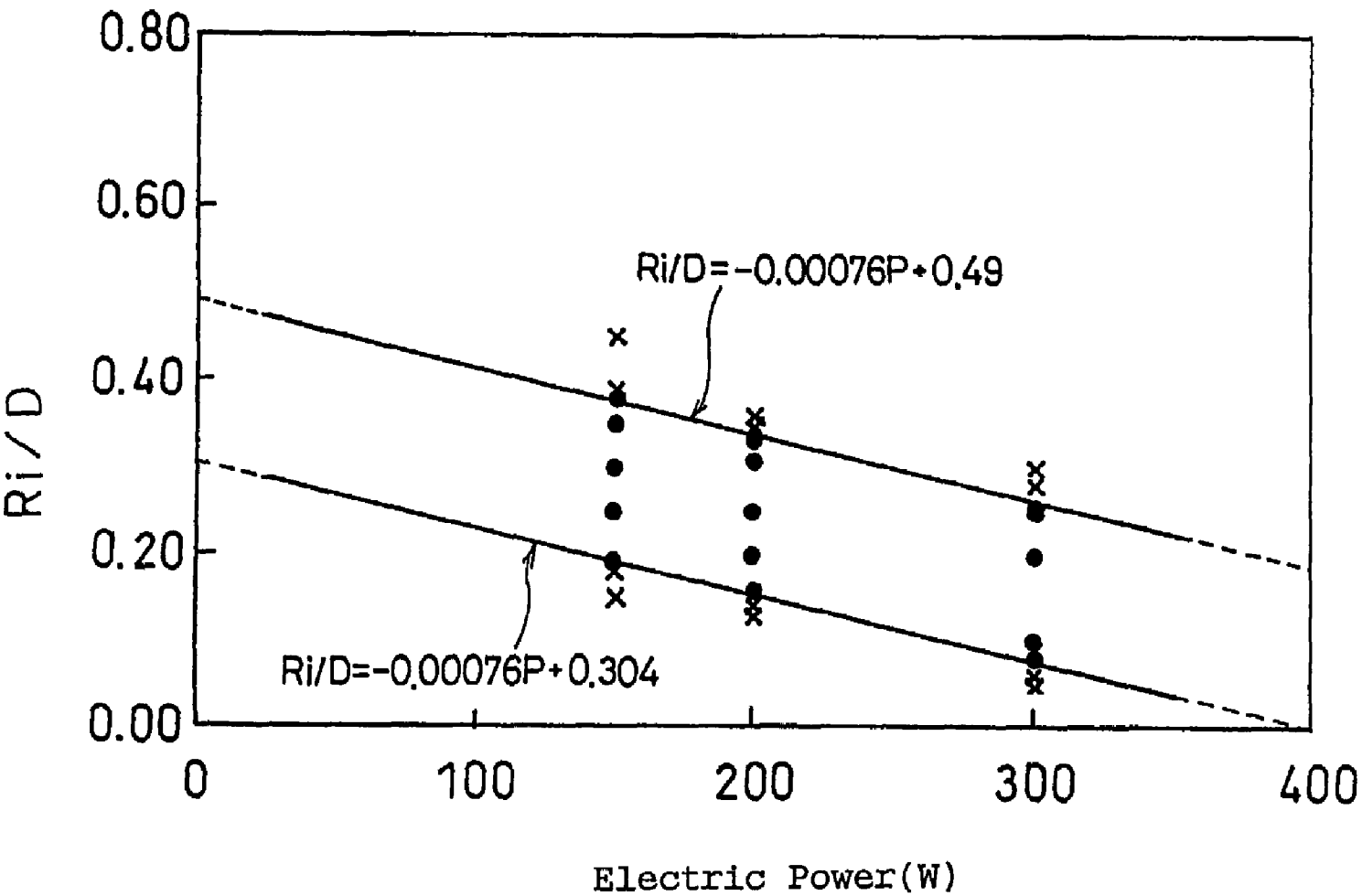
FIG. 3 is a graph of plots of the relationship between the lamp electric power P and $R_i$/D value, and of the range defined by Formula (1).

FIG. 3 is a plot diagram showing the relationship between the lamp electric power P and $R_i/D$ values. In FIG. 3, the cases of the color temperature variation not more than 302K are plotted with black points while the cases of the color temperature variation not less than 320 K are plotted with x marks.

It is understood from FIG. 3 that all the black points plotted distribute in the range sandwiched between the straight line: $R_i/D=-0.00076P+0.304$ and the straight line: $R_i/D=-0.00076P+0.490$.

It is to be noted that in the metal vapor discharge lamp of Example 1 satisfying $0.152 \leqq R_i/D \leqq 0.338$, the ratio ($R_i/R_o$) of the smallest curvature radius $R_i$ of the inner wall of the boundary portion between the center bulb and each of the side tubes to the smallest curvature radius $R_o$ of the external wall of the boundary portion was in the range: $1.28 \leqq R_i/R_o \leqq 1.39$ Similarly, in the metal vapor discharge lamp of Example 2 satisfying $0.076 \leqq R_i/D \leqq 0.262$, the ratio ($R_i/R_o$) was in the range: $1.28 \leqq R_i/R_o \leqq 1.39$.

Moreover, in the metal vapor discharge lamp of Example 3 satisfying $0.190 \leqq R_i/D \leqq 0.376$, the ratio ($R_i/R_o$) was in the range: $1.28 \leqq R_i/R_o \leqq 1.39$.

EXAMPLE 4

Next, except that the $R_i/D$ value was fixed to 0.20 and the $R_i/R_o$ value was varied in the range: $1.20 \leqq R_i/R_o \leqq 1.43$, where $3.0<R_1<5.0$, a metal vapor discharge lamp of 200 W was produced and then evaluated in the same manner as in Example 1.

Table 4 shows the relationship among the $R_i/D$ value, the $R_i/R_o$ value and the color temperature variation after the 6000 hour life test.

TABLE 4

| $R_i/D$ | $R_i/R_0$ | *A |
|---|---|---|
| 0.20 | 1.20 | 438 |
| | 1.27 | 361 |

TABLE 4-continued

| $R_i/D$ | $R_i/R_0$ | *A |
|---|---|---|
| | 1.28 | 283 |
| | 1.30 | 265 |
| | 1.33 | 270 |
| | 1.37 | 273 |
| | 1.39 | 298 |
| | 1.40 | 350 |
| | 1.43 | 420 |

*A: Color temperature variation (K) after the lapse of 6000 hour life

[Consideration 2]

It is revealed from the results of Table 4 that an excellent luminescence characteristic can be obtained in the range: $1.28 \leqq R_i/R_o \leqq 1.39$. With the $R_i/R_o$ value out of this range, on the other hand, the color temperature decreases on a large scale even when Formula (1) is satisfied (namely, even when $0.152 \leqq R_i/D \leqq 0.38$ (P=200) is satisfied).

Next, in metal vapor discharge lamps of 150 W and 300 W, respectively, the $R_i/R_o$ values were varied and the color temperature variations were measured when Formula (1) was satisfied. As a result, similarly to the case of the metal vapor discharge lamp of 200 W above, an excellent luminescence characteristic was obtained when the $R_i/R_o$ values satisfied: $1.28 \leqq R_i/R_o \leqq 1.39$; however, with the $R_i/R_o$ value out of this range, the color temperature widely decreased even when Formula (1) was satisfied

EXAMPLE 5

Except that the $R_i/D$ value was fixed to 0.31 and the $L_2/L_1$ value was varied, a metal vapor discharge lamp was produced and then evaluated in the same manner as in Example 1. Table 5 shows the relationship among the $L_2/L_1$ value, the $R_i/D$ value, the incidence of cracking in the vicinity of the boundary portion between the center bulb and each of the side tubes (cracking occurrence rate A) and the incidence of cracking in the portion hermetically sealed by the sealant (cracking occurrence rate B).

It should be noted that the incidence of cracking was observed for several tens of hours after the lamp had been turned on.

The cracking occurrence rate A is indicated by the number of lamps where cracking has occurred in the vicinity of the boundary portion, out of 10 lamps.

The cracking occurrence rate B is indicated by the number of lamps where cracking has occurred in the hermetically sealed portion, out of 10 lamps.

TABLE 5

| $L_2/L_1$ | $R_i/D$ | Cracking occurrence rate A | Cracking occurrence rate B |
|---|---|---|---|
| 0.25 | 0.31 | 3/10 | 0/10 |
| 0.27 | | 1/10 | 0/10 |
| 0.28 | | 0/10 | 0/10 |
| 0.30 | | 0/10 | 0/10 |
| 0.32 | | 0/10 | 0/10 |
| 0.36 | | 0/10 | 0/10 |
| 0.38 | | 0/10 | 0/10 |
| 0.39 | | 0/10 | 2/10 |

TABLE 5-continued

| $L_2/L_1$ | $R_i/D$ | Cracking occurrence rate A | Cracking occurrence rate B |
|---|---|---|---|
| 0.40 | | 0/10 | 3/10 |

[Consideration 3]

In Table 5, when the $L_2/L_1$ value is not more than 0.27, the cracking occurrence rate A is high; when the $L_2/L_1$ value is not less than 0.39, the cracking occurrence rate B is high. It is understood from the above results that the $L_2/L_1$ value preferably satisfies: $0.28 \leqq L_2/L_1 \leqq 0.38$, for preventing cracking from occurring.

Although the specific examples of the metal vapor discharge lamps of 150 W, 200 W and 300 W were described above, the present invention can also be applied to metal vapor discharge lamps with any electric powers in the range of 10 W to 350 W so that a stable luminescence characteristic can be sustained with a small color temperature variation even when the lamp is on for a long period of time.

As thus described, according to the present invention, it is possible to attain both inhibition of a liquid metal from flowing down into a gap between a current supplier and each of side tubes, and sustainment of favorable metal vapor pressure, thereby enabling production of a metal vapor discharge lamp where a stable luminescence characteristic can be sustained with a small color temperature variation even when the lamp is on for a long period of time.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

The invention claimed is:

1. A metal vapor discharge lamp, comprising:

(a) a translucent ceramic envelope, said ceramic envelope comprising a center bulb for defining a discharge space and side tubes being extended from both ends of said center bulb, said side tubes having outer diameters smaller than that of said center bulb, said center bulb and said side tubes being integrally molded;

(b) a pair of current suppliers extending through hollows of said side tubes respectively, each of said current suppliers comprising an electrode and a lead-in wire, said electrode being fixed with a coil disposed in said discharge space, a first end of said electrode being disposed in said discharge space, a second end of said electrode being connected with said lead-in wire;

(c) a sealant for hermetically sealing open ends of said side tubes to fix said lead-in wires to said side tubes; and (d) a light-emitting metal contained in said discharge space, wherein an inner wall of a seamless boundary portion between said center bulb and each of said side tubes has the smallest curvature radius of $R_i$ mm, an external wall of said boundary portion has the smallest curvature radius of $R_o$ mm, said center bulb has an inner diameter of D mm, said lamp has an electric power of P watts, and said curvature radius $R_i$, said curvature radius $R_o$, said diameter D and said electric power P satisfy:

$$-0.00076P+0.304 \leqq R_i/D \leqq -0.00076P+0.490, \quad \text{Formula (1)}$$

where $P \leqq 350$ watts; and $$1.28R_o \leqq R_i \leqq 1.39R_o. \quad \text{Formula (2)}$$

2. The metallic vapor discharge lamp in accordance with claim 1, wherein a distance ($L_1$) between said first end of said electrode and said open end of said side tube which is nearer to said first end, and a distance ($L_2$) between said first end and a position where an inner wall of said nearer side tube begins to bend, satisfy:

$$0.28 \leqq L_2/L_1 \leqq 0.38. \quad \text{Formula (3)}$$

* * * * *